US008592684B2

(12) United States Patent
Clayton et al.

(10) Patent No.: US 8,592,684 B2
(45) Date of Patent: Nov. 26, 2013

(54) ELECTRICAL INSULATING CAP FORMATION

(75) Inventors: Patrick Clayton, Worthing (GB); Patrick Hester, Pullborough (GB)

(73) Assignee: Lamina Dielectrics Limited, Billingshurst (GB)

( * ) Notice: Subject to any disclaimer, the term of this patent is extended or adjusted under 35 U.S.C. 154(b) by 87 days.

(21) Appl. No.: 13/391,276

(22) PCT Filed: Aug. 20, 2010

(86) PCT No.: PCT/GB2010/001582

§ 371 (c)(1), (2), (4) Date: Feb. 17, 2012

(87) PCT Pub. No.: WO2011/021010

PCT Pub. Date: Feb. 24, 2011

(65) Prior Publication Data

US 2012/0138334 A1 Jun. 7, 2012

(30) Foreign Application Priority Data

Aug. 21, 2009 (GB) ..... 0914698.6

(51) Int. Cl.
*H01B 17/00* (2006.01)

(52) U.S. Cl.
USPC ..... 174/148; 174/149; 174/137 R; 174/188

(58) Field of Classification Search
USPC ..... 174/148, 135, 137 R, 145, 149 R, 152 R, 174/152 G, 77 R, 84 R, 71 R, 72 R, 72 A, 188, 174/138 F, 76, 186; 16/2.1, 2.2; 248/68.1, 248/49, 65, 73; 439/521
See application file for complete search history.

(56) References Cited

U.S. PATENT DOCUMENTS

| | | | | |
|---|---|---|---|---|
| 2,701,273 | A * | 2/1955 | Badeau | 174/138 F |
| 3,550,856 | A | 12/1970 | Wise et al. | |
| 3,829,635 | A * | 8/1974 | Elwert et al. | 174/138 F |
| 4,435,615 | A * | 3/1984 | Kaczerginski et al. | 174/186 |
| 4,732,628 | A | 3/1988 | Dienes | |
| 6,729,903 | B1 * | 5/2004 | Clark | 439/521 |
| 7,074,077 | B2 * | 7/2006 | Sakaguchi et al. | 439/521 |
| 7,109,423 | B1 | 9/2006 | Bukovnik et al. | |
| 7,112,745 | B2 | 9/2006 | Hatori | |
| 7,327,057 | B2 | 2/2008 | Ito et al. | |
| 7,663,059 | B2 * | 2/2010 | Daitou | 174/77 R |

FOREIGN PATENT DOCUMENTS

| | | |
|---|---|---|
| EP | 1657794 | 5/2006 |
| GB | 1 334 556 | 10/1973 |
| GB | 1 442 644 | 7/1976 |
| JP | 10 304537 | 11/1998 |
| WO | WO 2007/089853 | 8/2007 |

* cited by examiner

*Primary Examiner* — Angel R Estrada
(74) *Attorney, Agent, or Firm* — Levy & Grandinetti

(57) ABSTRACT

An electrical insulating cap formation is disclosed. The electrical insulating cap formation includes a strip of material and one or more electrical insulating caps each comprising a tubular section and a closed end section, in which the one or more electrical insulating caps are carried on the strip of material by their end sections. The strip of material includes a wing portion which extends over at least a part of the tubular sections of the one or more electrical insulating caps. The strip of material is formed such that an outer edge of the wing portion is spaced apart from the tubular sections of the one or more electrical insulating caps.

14 Claims, 3 Drawing Sheets

ELECTRICAL INSULATING CAP FORMATION

This application is the U.S. National Phase of International Application Number PCT/GB2010/001582 filed on Aug. 20, 2010, which claims priority to Great Britain Application Number 0914698.6 filed on Aug. 21, 2009.

This invention relates to an electrical insulation cap formation for use particularly, but not exclusively, for fitting to crimped electrical wire connections in electrical motors.

It is known to provide heat shrinkable insulating caps for insulating electrical components, such as crimped connections to magnet wires within electric motors, or thermal switches used within motor windings.

Such caps are made from tubes which are wound from a combination of different polymeric films provided in strips. The formed tubes are cut into small pieces, before one end is closed by flattening an end of the tube and welding it together, or heat forming it into that shape.

With this construction the caps have electrical and mechanical properties which are difficult to produce by other means. For example, by forming the tubes from different films the resulting caps can have a modified polyamide interior layer and a heat shrinkable polyester outer layer. As such a high temperature heat shrinkable modified polyamide cap can be produced, which is also capable of absorbing insulation varnishes during the manufacture of an electric motor, and hence has high dielectric strength at high temperatures.

Once the crimped connections to magnet wires or other components inside an electrical motor have been provided with an insulating cap, that cap is then lodged in the windings of the motor, usually by hand. However, this can be difficult to achieve because the caps comprise a smooth tubular shape with a tapering end section, and unless they are firmly wedged under or between the windings, they can become dislodged. This issue is exacerbated when three crimped connections to magnet wires need to be secured in position.

The present invention is intended to overcome some of the above problems.

Therefore, according to the present invention an electrical insulating cap formation comprises a strip of material and one or more electrical insulating caps each comprising a tubular section and a closed end section, in which the one or more electrical insulating caps are carried on the strip of material by their end sections, in which the strip of material comprises a wing portion which extends over at least a part of the tubular sections of the one or more electrical insulating caps, and in which the strip of material is formed such that an outer edge of said wing portion is spaced apart from the tubular sections of the one or more electrical insulating caps.

This construction provides an effective barb for securing one or more electrical insulating caps in the windings of an electric motor, as the formation can be pushed into the windings end section first, and once inside the wing portion can act to prevent the removal of the formation therefrom.

In addition, the strip of material can serve to fix a plurality of caps together in a grouped formation, which is beneficial where a number of crimped connections require insulation, for example the three grouped crimped connections to magnet wires in an electrical motor. Where previously three separate wires needed to be manually provided with an insulating cap, then all three wires needed to be lodged in the windings of an electric motor, which takes time and can result in repetitive strain injuries, the formation of the invention allows for only one component to be used, which can be readily lodged in the windings of the motor.

The electrical insulating caps can be arranged at any orientation to the strip of material as required, for example at 45 degrees thereto. However, in a preferred construction the one or more electrical insulating caps can each comprise a lengthwise axis; the strip of material can comprise a lengthwise axis; and the one or more electrical insulating caps can be carried on the strip of material with their lengthwise axes substantially normal to the lengthwise axis of the strip of material.

An outer edge of said wing portion can be greater in length than an inner edge of the strip of material, such that first and second ends of the strip of material are angled in relation to the lengthwise axis of the one or more electrical insulating caps. With this shape, the wing portion also forms a barbed shape in a plane parallel to the lengthwise extent of the strip of material, which further enhances its functionality.

In addition to this, the inner edge of the strip of material can be greater in length than a width of the end sections of the one or more electrical insulating caps. This feature increases the size of the barb feature, but it also has a beneficial purpose during one possible method of manufacture. The applicant has a co-pending patent application for an electrical insulating cap formation comprising a strip of material and a plurality of electrical insulating caps carried thereon in a row, in which intervals are provided between each, or groups of two or more, of the electrical insulating caps. The formation of that invention is intended to be cut up into components like that of the present invention. In some embodiments the continuous strip of material is provided with a barb feature like that of the present invention. In those embodiments the interval between the groups of caps is necessary to prevent damage being caused to the caps during cutting, because cutting of the strip of material serves to flatten it, and if this were performed too close to the caps, they could also be flattened and therefore damaged. (This is particularly true of the double sided barb formation described below.)

Preferably the formation can be provided with a barb feature on both sides thereof. Therefore, the strip of material can be folded along a line substantially parallel to its lengthwise axis, and end sections of the one or more electrical insulating caps can be disposed inside the strip of material with a first section of the strip of material extending over a first side of said one or more end sections and a second section of the strip of material extending over a second side of said one or more end sections.

The wing portion described above can extend from said first section of the strip of material, and a second wing portion can extend from said second section of the strip of material. The second wing portion can also extend over at least a part of tubular sections of the one or more electrical insulating caps. The strip of material can be formed such that an outer edge of the second wing portion is spaced apart from said tubular sections of the one or more electrical insulating caps.

Again, the wing portions can form a barbed shaped in a plane parallel to the lengthwise extent of the strip of material. The outer edges of the wing portion and the second wing portion can be greater in length than the folded part of the strip of material, such that first and second ends of the strip of material are angled in relation to the lengthwise axes of the one or more electrical insulating caps.

As above, the folded part of the strip of material can be greater in length than a width of the end sections of the one or more electrical insulating caps. This shape results from the advantageous method of manufacture described above.

The strip of material can be formed with folds which facilitate the spacing of the outer edges from the caps. Alternatively, the strip of material can simply be formed from a resilient material which adopts this position by virtue of being placed over the caps.

Preferably the closed end sections of the one or more electrical insulating caps can each comprise a flattened section of the tubular section welded together.

In a preferred construction the end sections of the one or more electrical insulating caps can be welded to the strip of material. This can be achieved with an ultrasonic weld, or a heat activated weld.

In one construction the end sections can be welded to the strip of material with the same weld which forms the closed end section. This arrangement reduces the number of constructional steps.

Preferably the electrical insulating caps can be heat shrinkable. The invention includes heat shrinkable electrical insulating caps of any material, including simple moulded items made from a single body of insulating material for example rubber or any appropriate plastics material, but preferably the electrical insulating caps can be formed from wound polymeric films, like the advantageous type described above. It will be appreciated that the invention includes a formation comprising a strip of material and just one electrical insulation cap. However, in a preferred embodiment, the formation can comprise three such caps, which embodiment finds particular application with the three grouped crimped connections to magnet wires in an electrical motor.

The invention can be performed in various ways, but four embodiments will now be described by way of example, and with reference to the accompanying drawings, in which FIG. 1 is a perspective view of a first electrical insulating cap formation according to the present invention;

(In the following description like components in the four different embodiments of the present invention are given the same reference number.)

Figure 1:
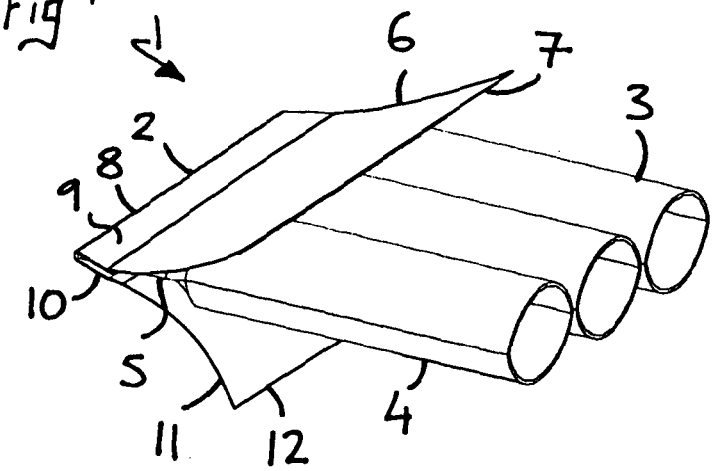

As shown in FIG. 1, an electrical insulating cap formation 1 comprises a strip of material 2 and one or more electrical insulating caps, in the form of three heat shrinkable electrical insulating caps 3. Each cap comprises a tubular section 4 and a closed end section 5, and the caps 3 are carried on the strip of material 2 by their end sections 5. The strip of material 2 comprises a wing portion 6 which extends over a part of the tubular sections 4 of the caps 3, and as is clear from FIG. 1 the strip of material 2 is formed such that an outer edge 7 of said wing portion 6 is spaced apart from the tubular sections 4 of the caps 3.

The caps 3 are formed from different polymeric films wound into a tube, which is then cut into pieces. The closed end section 5 comprises a flattened section of the tube welded together. The caps 3 comprise a lengthwise axis, and they are carried on the strip of material 2 normal to a lengthwise axis of the strip of material 2.

The strip of material 2 is constructed from a plastics material, and the caps 3 are ultrasonically welded to it. The caps 3 are welded to the strip of material 2 with the same weld which is used to form the closed end sections 5.

Formation 1 comprises a barb feature on both sides thereof. As such, the strip of material 2 is folded along a line 8 substantially parallel to its lengthwise axis, and the end sections 5 of the caps 3 are disposed inside the strip of material 2 with a first section 9 thereof extending over one side of the end sections 5, and a second section 10 extending over the other side of the end sections 5.

The wing portion 6 extends from the first section 9, and a second wing portion 11 extends from the second section 10. The second wing portion 11 is like the first, and extends over a part of the tubular sections 4 of the caps 3, with an outer edge 12 thereof spaced apart from said tubular sections 4.

The outer edges 7 and 12 of the wing portions 6 and 11 assume the position shown in FIG. 1 because the strip of material 2 is formed from a semi-rigid plastics material, and the shape of the part of the caps 3 disposed inside the strip of material 2 forces the wing portions 6 and 11 to splay outwards.

To construct formation 1 the end sections 5 are placed inside the strip of material 2, and an ultrasonic weld is applied to the first and/or second sections 9 and 10 thereof, which acts to weld all the material in that area together.

Formations 1 was cut from a longer formation (not shown) comprising multiple separated groups of three caps 3. Formation 1 was formed by cutting the longer formation at a mid point of an interval provided between the groups of caps 3, and as such sections of the strip of material 2 extend out of either side of the formation 1 beyond the caps 3. This is necessary to prevent damage being caused to the caps 3. Cutting of the folded strip of material 2 serves to flatten it, and if this were performed too close to the caps 3, they could also be flattened and therefore damaged.

It will be appreciated that a formation of exactly the same shape as formation 1 could also be made from a strip of material 2 already cut to the size shown in FIG. 1, but this would be a less practical method of manufacture.

The formation 1 is specifically intended for use with the three grouped crimped connections to magnet wires in an electric motor. Once shrunk into place on the crimped connections, the formation 1 can be pushed into the windings of the motor end sections 5 first, during which action the wing portions 6 and 11 will tend to be forced against the caps 3. Once inside the windings the wing portions 6 and 11 can unfurl to an extent and serve to hold the formation 1 in position.

It will be appreciated that formation 1, or a formation like formation 1 but comprising one, two or four or more caps 3, could also be employed in other constructions where a barb feature may be advantageous.

Figure 2:
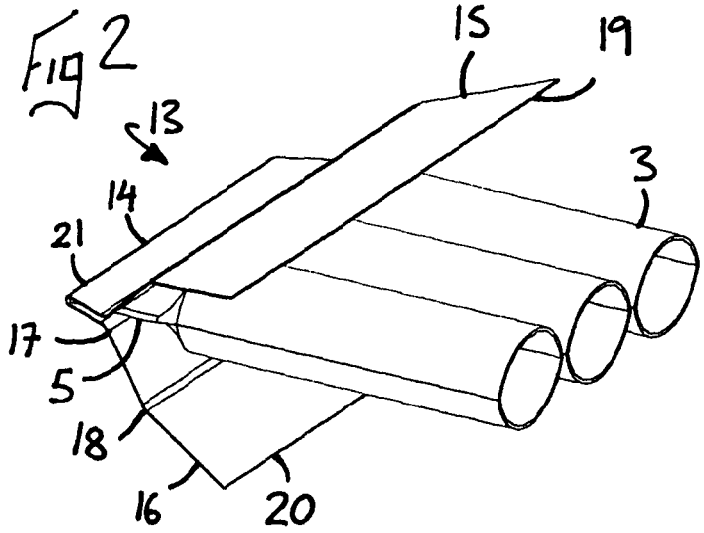
FIG. 2 is a perspective view of a second electrical insulating cap formation according to the present invention.
Figure 3:
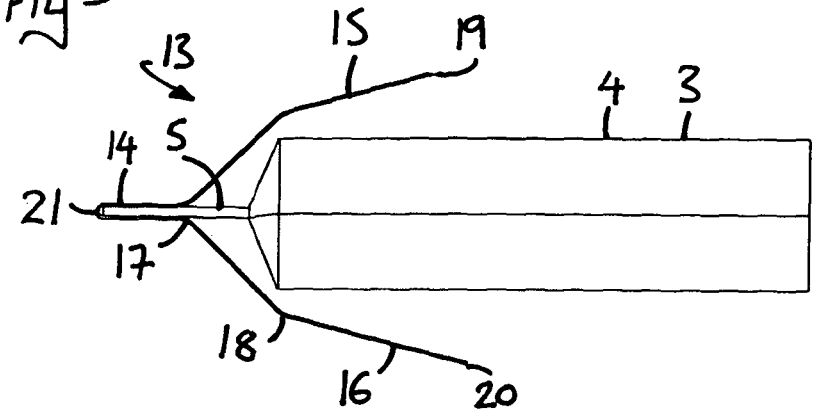
FIG. 3 is an end view of the second electrical insulating cap formation as shown in FIG. 2.
Figure 4:
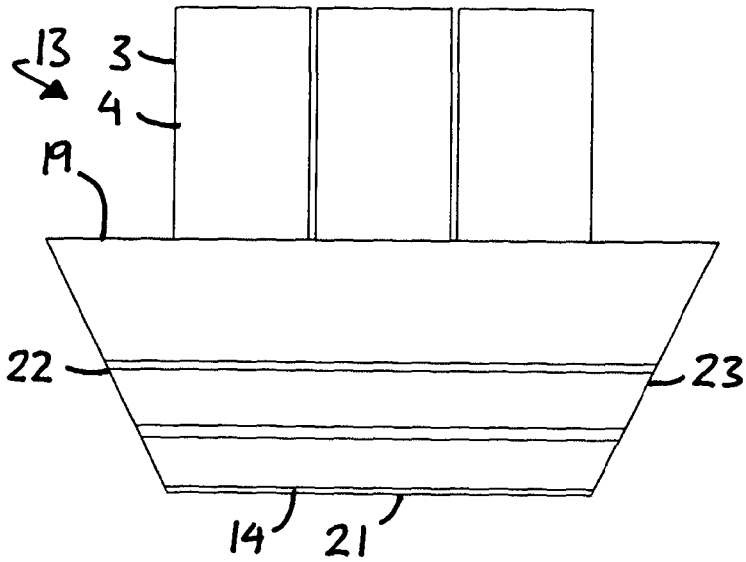
FIG. 4 is a side view of a the second electrical insulating cap formation as shown in FIG. 2.

FIGS. 2 to 4 show a second formation 13, which is like formation 1, except that the strip of material 14 has a different shape. In particular, rather than abutting against the caps 3, the wing portions 15 and 16 are each provided with two folds 17 and 18 in opposite directions, such that they extend out and over the caps 3.

In addition to this, the outer edges 19 and 20 of the wing portions 15 and 16 are greater in length than the folded part 21 of the strip of material 14, such that first and second ends 22 and 23 of the strip of material 14 are angled in relation to the lengthwise axes of the caps 3. As such, the wing portions 15 and 16 form a barbed shape in a plane parallel to the lengthwise extent of the strip of material 14. With this shape, the wing portions 15 and 16 can engage with the winding of an electric motor in two orthogonal planes, which increases the ability of the formation 13 to be secured in place therein.

Again, formation 13 was cut from a longer formation comprising multiple separated groups of caps 3. However, in order to achieve the angled edges 22 and 23, it was necessary to make two cuts in the intervals between the groups of caps 3 to create the two edges 22 and 23 of adjacent formations 13. However, the angled shape has the advantage that the cutting is sufficiently spaced from the tubular part 4 of the caps 3 to prevent any damage being caused. As with formation 1, formation 13 could also be created separately from strips of material 14 already cut to size.

As referred to above, the invention is not limited to formations comprising a group of three caps 3, and one, two or four or more caps could be provided. By way of illustration FIGS. 5 and 6 show embodiments comprising only one cap.

Figure 5:
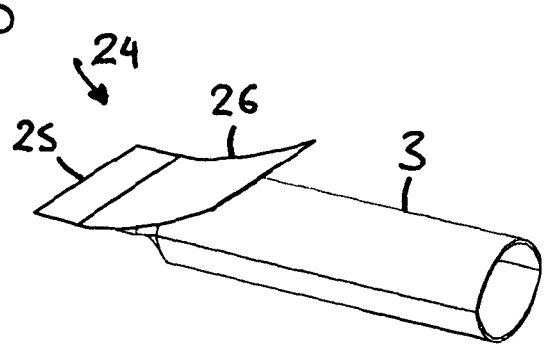
FIG. 5 is a perspective view of a third electrical insulating cap formation according to the present invention.

FIG. 5 shows formation 24 which comprises single cap 3, and strip of material 25 which is only single sided, such that formation 24 only has a barb feature on one side thereof. The strip of material 25 comprises a simple strip with the end section 5 of the cap 3 welded to one side, and a single wing portion 26 extends from the strip of material 25 over the cap 3 in the same manner as wing portion 6 in formation 1. A single sided construction of this type may be preferred as it is simpler to produce and consumes less raw material. A single cap 3 formation finds application where only one crimped connection needs to be insulated, as in the case of a thermal switch used in an electrical motor winding.

Figure 6:
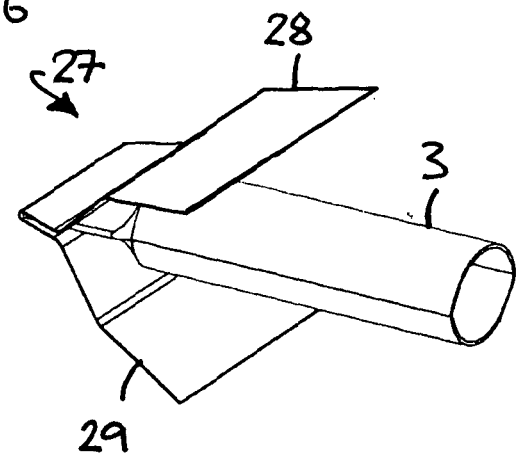
FIG. 6 is a perspective view of a fourth electrical insulating cap formation according to the present invention.

FIG. 6 shows formation 27 which is like formation 13 described above, except that it comprises only one cap 3. As such, formation 27 comprises wing portions 28 and 29 on both sides, which both feature folds to give them shape.

As with formations 1 and 13 described above, formations 24 and 27 are cut from long formations, but this time individual caps 3 are spaced apart on the long formation. Again, formations 24 and 27 could also be created from strips of material already cut to size if preferred.

Therefore, the present invention provides a formation of electrical insulating caps provided with an advantageous barb feature to allow them to be more readily fitted into the windings of an electric motor. The formation of the invention also allows groups of caps to be fixed together, which is advantageous when multiple crimpled wire connections need to be insulated.

The invention claimed is:

1. An electrical insulating cap formation comprising a strip of material and one or more electrical insulating caps each comprising a tubular section and a closed end section, in which the one or more electrical insulating caps are carried on the strip of material by their end sections, in which the strip of material comprises a wing portion which extends over at least a part of the tubular sections of the one or more electrical insulating caps, and in which the strip of material is formed such that an outer edge of said wing portion is spaced apart from the tubular sections of the one or more electrical insulating caps.

2. An electrical insulating cap formation as claimed in claim 1 in which the one or more electrical insulating caps each comprise a lengthwise axis, in which the strip of material comprises a lengthwise axis, and in which the one or more electrical insulating caps are carried on the strip of material with their lengthwise axes substantially normal to the lengthwise axis of the strip of material.

3. An electrical insulating cap formation as claimed in claim 2 in which said outer edge of said wing portion is greater in length than an inner edge of the strip of material, such that first and second ends of the strip of material are angled in relation to the lengthwise axes of the one or more electrical insulating caps.

4. An electrical insulating cap formation as claimed in claim 3 in which the inner edge of the strip of material is greater in length than a width of the end sections of the one or more electrical insulating caps.

5. An electrical insulating cap formation as claimed in claim 2 in which the strip of material is folded along a line substantially parallel to its lengthwise axis, in which the end sections of the one or more electrical insulating caps are disposed inside the strip of material with a first section of the strip of material extending over a first side of said one or more end sections and a second section of the strip of material extending over a second side of said one or more end sections.

6. An electrical insulating cap formation as claimed in claim 5 in which said wing portion extends from said first section of the strip of material, and in which a second wing portion extends from said second section of the strip of material, which second wing portion extends over at least a part of the tubular sections of the one or more electrical insulating caps, and in which the strip of material is formed such that an outer edge of said second wing portion is spaced apart from the tubular sections of the one or more electrical insulating caps.

7. An electrical insulating cap formation as claimed in claim 6 in which said outer edges of the wing portion and the second wing portion are greater in length than the folded part of the strip of material, such that first and second ends of the strip of material are angled in relation to the lengthwise axes of the one or more electrical insulating caps.

8. An electrical insulating cap formation as claimed in claim 7 in which the folded part of the strip of material is greater in length than a width of the end sections of the one or more electrical insulating caps.

9. An electrical insulating cap formation as claimed in claim 1 in which the closed end sections of the one or more electrical insulating caps each comprise a flattened section of the tubular section welded together.

10. An electrical insulating cap formation as claimed in claim 9 in which the end sections of the one or more electrical insulating caps are welded to the strip of material.

11. An electrical insulating cap formation as claimed in claim 10 in which the end sections of the one or more electrical insulating caps are welded to the strip of material with the same weld which forms the closed end section.

12. An electrical insulating cap formation as claimed in claim 1 in which the electrical insulating caps are heat shrinkable.

13. An electrical insulating cap formation as claimed claim 1 in which the electrical insulating caps are formed from wound polymeric films.

14. An electrical insulating cap formation as claimed in claim 1 in which the formation comprises three electrical insulating caps.

* * * * *